US006660333B2

(12) United States Patent
Frame

(10) Patent No.: US 6,660,333 B2
(45) Date of Patent: Dec. 9, 2003

(54) APPARATUS AND METHODS FOR PRODUCING ARTIFICIALLY DISTRESSED PLANK FLOORING

(76) Inventor: David Frame, 10051 Boyce Rd., Chelsea, MI (US) 48118

( * ) Notice: Subject to any disclaimer, the term of this patent is extended or adjusted under 35 U.S.C. 154(b) by 124 days.

(21) Appl. No.: 09/771,696

(22) Filed: Jan. 29, 2001

(65) Prior Publication Data

US 2002/0132050 A1 Sep. 19, 2002

(51) Int. Cl.[7] ..... B05D 3/12; B05D 5/00

(52) U.S. Cl. ..... 427/271; 427/274; 427/275; 427/291; 427/325; 427/510; 144/358; 144/360; 144/368

(58) Field of Search ..... 427/271, 274, 427/275, 280, 291, 325, 510; 144/2.1, 3.1, 4.1, 136.1, 360, 367, 368, 358

(56) References Cited

U.S. PATENT DOCUMENTS

| | | | | |
|---|---|---|---|---|
| 3,247,047 A | * | 4/1966 | Buckley | |
| 3,756,295 A | * | 9/1973 | Halop | |
| 3,848,647 A | * | 11/1974 | Fell | |
| 3,967,007 A | | 6/1976 | Lee | 427/223 |
| 4,116,248 A | | 9/1978 | Erwin | 144/2 R |
| 4,207,936 A | | 6/1980 | Arbour | 144/320 R |
| 4,558,725 A | | 12/1985 | Veneziale | 144/362 |
| 4,945,959 A | | 8/1990 | Biedenbach | 144/134 R |
| 5,562,955 A | | 10/1996 | Kam | 428/14 |
| 5,601,876 A | | 2/1997 | Oates et al. | 427/257 |
| 5,950,382 A | | 9/1999 | Martino | 52/311.1 |
| 5,987,217 A | * | 11/1999 | Wisniewski et al. | |
| 5,989,681 A | | 11/1999 | Martino | 428/151 |
| 6,261,035 B1 | * | 7/2001 | Moores, Jr. et al. | |

* cited by examiner

*Primary Examiner*—Fred J. Parker
(74) *Attorney, Agent, or Firm*—Gifford, Krass, Groh, Sprinkle, Anderson & Citkowski, PC

(57) ABSTRACT

Methods and apparatus for distressing a wooden plank give the plank an antique, aged appearance. The preferred method includes four independent steps. The plank is run through an inventive machine operative to impart a random saw blade distressing on the plank. This step is preferably carried out as a single stream in a machine having a plurality of saw arbors, each driven by its own rotating cam. To impart the most random pattern, each cam preferably has a different shape and rotates at a different speed. The plank is preferably fed into a roller having raised portions operative to produce random dents and impressions into the plank. This step is preferably carried out in multiple streams using a machine having a large roller or drum with protrusions affixed thereto. The plank is then fed into a profile sander having one or more wire wheels operative to apply a surface texture to the plank, then sanding and smoothing the plank with abrasive wheels. Finally, a surface finish is applied to the plank which simulates an antique wood floor. In the preferred embodiment, the edges and ends of the plank are beveled and stained darker than the rest of the plank. In addition, assuming the plank has areas of hard grain and areas of soft grain, the technique preferably includes the steps of darkening the soft grain while lightening the hard grain to yield an aged appearance.

9 Claims, 3 Drawing Sheets

APPARATUS AND METHODS FOR PRODUCING ARTIFICIALLY DISTRESSED PLANK FLOORING

FIELD OF THE INVENTION

This invention relates generally to distressed wood products and, more particularly, to machines and processes whereby plank flooring is treated to produce a distressed appearance.

BACKGROUND OF THE INVENTION

Machines for preparing wood flooring have been in operation for nearly two centuries. In the middle of the last century, planers, jointers and other woodworking machinery was beginning to be more commonly available and, as a result, flooring started to change from rough saw planks to planned, tongue and grooved flooring. In 1828, William Woodworth was issued a patent for a wood planing machine with power feed rollers that also had the capability to tongue and groove the edges of the board. Intentionally, only a limited number of these machines were built, so that the subsequent owners of the patent could charge a royalty for use of the machine. The patent was renewed twice and finally expired in 1865. The demand for planing grew rapidly during this period, with the Whitney company building its first commercial planer in 1860. By the late 1800s to early 1900s, flooring manufacturing equipment had progressed to the point where 2¼" wide tongue and groove strip flooring was a mass-produced commodity. In homes built during this era, it is much more common to find 2¼" wide strip flooring of hardwood instead of plank flooring.

Prior to the mid 1800s and during colonial times, random-width, rough-sawn plank floors were installed in homes and used as flooring without being surfaced. After many years, even up to one hundred years later, some of these floors were sanded down to give a flatter smoother floor and stained and finished. This sanding left a rough sawn texture in the "low spots" in the planks while most of the floor was smooth. After staining and finishing these floors were used for many more years (another century in some cases). The floors were subject to boot traffic, high heels, dirt, small stones and other forms of distressing with very little, if any, finish to protect the wood. These years of use produced a floor full of dents, texture from saw marks, and wear that is unique. For those wishing to continue using such authentically distressed material, the plank floor is very carefully preserved by lightly sanding and refinishing, leaving as much of the original character, color, and texture as possible including the dark edges, dents, and black color down in the grain.

There is a growing desire for wood products that have an antique or aged appearance, but being so rare, naturally distressed material tends to be very expensive. The process of distressing and prefinishing solid plank flooring is therefore being used to simulate authentic, random-width plank floors. Various products, including hardwood flooring, are currently being remanufactured to produce an appearance of wood that has been reclaimed or aged.

Two distinct processes are being used to produce this age or distressed appearance. According to one method, reclaimed flooring beams are being taken from older factory floors or older barn beams as these structures are being torn down. These beams, which are typically 4"–10" thick, are being sawn or split into thinner solid wood blanks and remanufactured through milling. This process is being used to produce ¾" solid tongue and groove flooring in widths from 2¼"–20", as well as thin sawn "veneer-style" sheets which are laminated on to multi-layer plywood substrates. The antique or distressed appearance of floors manufactured from reclaimed lumber is characterized by the very nature of the material resource being used.

According to a different approach, standard manufactured solid wood floors are being artificially "distressed" to simulate a specified appearance. The distressing process is generally carried out through extensive manual labor used to produce the random appearance rather than a predictable "machined" look. This manual distressing process is accomplished using combinations of hand tools and hand techniques. Known techniques include

- hand scraping using various hand drawn scrapers and knives to "scoop" out wood fiber;
- hand sanding equipment including air powered and belt powered sanders to randomly remove wood fiber;
- gouges, chisels, hammers or other tools to produce nicks, cuts, or other marks that simulate the appearance of wear that is evident in an old wood floor; and
- use of chemicals such as bleach or acids to discolor wood fiber.

The use of machinery to produce the distress effect has been limited to four processes. Wire brushing has been utilized by the Memphis Hardwood Flooring Co. (Memphis, Tenn. 38107) to produce two products called "Cabin Strip" and "Weathered Plank." Both of these products are aggressively wire brushed to remove large amounts of wood fiber from the soft grain of oak strip flooring and oak plank flooring.

A process called "skip sawing" has also been used to simulate the grooves left by a large saw at the sawmill when a log is milled into rough lumber. According to this process, a percentage of boards to be treated are passed along a fixed saw blade. The saw blade/machinery is placed on a fixed angle and height to allow the blade to remove wood fiber in a circular appearance.

Other processes are being used to produce impressions and indentations. Such a technique being used by the Bruce Hardwood Floors, a division of Armstrong, Addison, Tex. 75001, is using such a process on laminated plank flooring. As a further process, angled milling is being used by Buell Flooring Group (Dallas, Tex. 75223) in their product "Old Boston Plank."

In terms of finish processes for distressed flooring, some companies that offer hand distressed products offer their product already finished. Application of color and finish be these companies is done by hand with color being applied by hand and finish being applied be either hand brushing or air borne spray application. Machine applied finishes are standard-rolled on ultraviolet-cured urethane coatings, a finish that is offered by Bruce on its American Originals and by Buell on its "Old Boston Plank." Memphis Flooring offers a hot wax finish on its Log Cabin Strip and Weathered Plank products. Distressed flooring is also being sold unfinished. In this case, contractor on the job site supplies manual labor and job site finishes to provide a finished surface.

Although machines exist for artificially distressing wood surfaces, such machines are limited in terms of visual effect. U.S. Pat. No. 3,756,295, for example, teaches a device for mechanically creating a "hand hewn" effect on wood planking. The treated surface is provided with a plurality of arcuately-shaped, randomly spaced indentations resembling the cuts of an adze. The device includes a frame element forming a generally horizontal supporting plane for serially fed planks. Disposed beneath the plane is a plurality of rotatably driven cutters having radially positioned blades which successively contact the undersurface of the plank as it is advanced at a substantially uniform rate to cut the surface thereof. First means are provided to randomly shift the cutters along an axis perpendicular to that of the path of movement of the planks, and second means are provided to simultaneously randomly move the cutting edges of the blades in a direction perpendicular to the plane of the plank to vary the depth of cut. Means are further provided for subsequently sanding the treated surface and for optionally slitting the plank longitudinally.

U.S. Pat. No. 5,987,217 discloses a programmable furniture texturing robotic system. A furniture texturing tool attachable to and detachable from the arm of the robot includes either a furniture chattering tool unit or a furniture distressing multi-tool turret. The furniture chattering tool unit has a circular saw blade which produces surface chatter marks when it is dragged across the surface of a furniture part. The furniture distressing tool unit has a plurality of furniture distressing tools, each of which produce a plurality of furniture distress marks including simulated wood rot, worm holes, hatchet marks, rock marks, wood split marks, crooked vein lines, and cigarette burn marks.

Although existing processes used to artificially distress flooring are in some case automated, the combination of random skip sawing, random worm distressing and "pebbling," wire brush wear-distressing, and a multi-layer color/clear-coat finish have been specifically designed to reproduce the finished appearance of authentic antique solid plank flooring. The need remains, therefore, for apparatus and automated processes to produce a distressed wood plank floor completely and intentionally through mechanical processing.

SUMMARY OF THE INVENTION

This invention resides in methods and apparatus for distressing a wooden plank so as to give it an antique aged appearance. The preferred method includes four independent steps. The plank is run through an inventive machine operative to impart a random saw blade distressing on the plank. This step is preferably carried out as a single stream in a machine having a plurality of saw arbors, each driven by its own rotating cam. To impart the most random pattern, each cam preferably has a different shape and rotates at a different speed.

The plank is preferably fed into a roller operative to produce dents and impressions into the plank. This step is preferably carried out in multiple streams using a machine having a large roller or drum with protrusions affixed thereto. The plank is then fed into a profile sander having one or more wire wheels operative to apply a surface texture to the plank, then sanding and smoothing the plank with abrasive wheels. Finally, a surface finish is applied to the plank which simulates an antique wood floor.

In the preferred embodiment, the step of applying a surface finish to the plank includes beveling the edges and ends of the plank. In addition, assuming the plank has areas of hard grain and areas of soft grain, the technique preferably includes the steps of darkening the soft grain while lightening the hard grain to yield an aged appearance.

DETAILED DESCRIPTION OF THE INVENTION

Before describing the preferred processes and examples of particular distressing protocols, the machines used to carry out the various operations will first be described in detail with reference to the figures.

Random Saw Distresser

Figure 1:
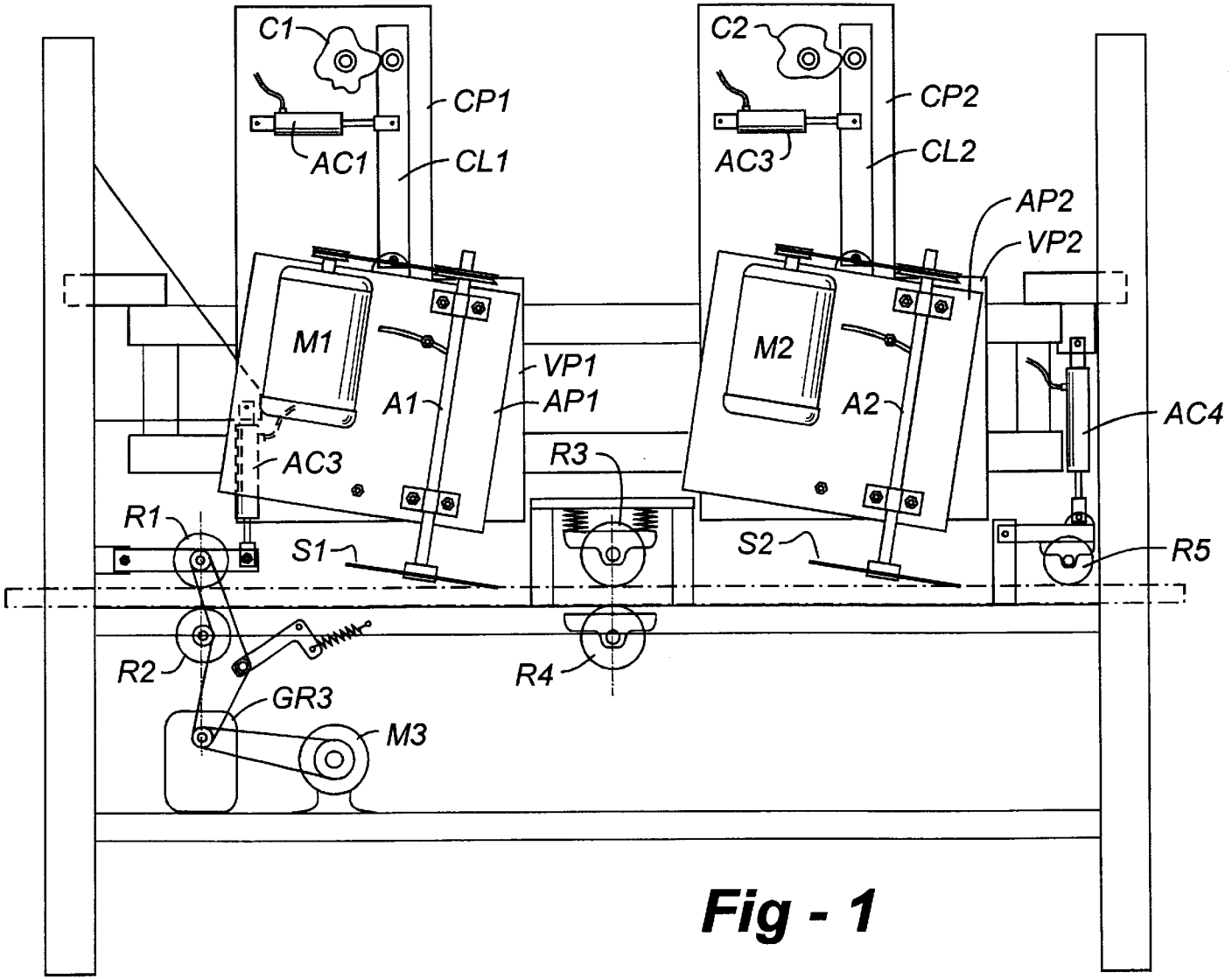
FIG. 1 is an overview drawing of a random saw distressing machine according to the invention.

Details of this machine are shown in FIGS. 1 through 4. The machine is setup to feed like a typical wood molder, as a single stream, one plank at a time, end to end, in random lengths of consistent width within the batch. The machine is adjustable for multiple widths from 3" to 7" wide. Reference is made to FIG. 1 and the following table, which lists important components by reference designation:

| Label | Description |
|---|---|
| C1, C2 etc. | Cams |
| AC1–AC4 | Air cylinders |
| CL1, CL2 | Plate for cam unit, note gear reducer for cam is mounted on back side of this plate, not shown in drawing 1. See drawing 4 and 5 for cam drives. |
| M1, M2 | Arbor Motors |
| A1, A2 | Saw Arbors |
| S1, S2 | 14" sawblade |
| AP1, AP2 | Plate for saw arbor unit, pivot shown on AP2 |
| VP1, VP2 | Vertical adjustment plates |
| BEAM | Adjustable beam, adjusts horizontally |
| R1, R2 | Urethane coated feed rollers |
| R3–R5 | Smooth steel hold-down rollers |
| GR3 | Gear reducer, 60:1, drives feed rollers |
| M3 | Feed system motor |

The feed system uses variable speed pulleys and an adjustable motor base to drive a 60:1 gear reducer GR3. The output of the gear reducer GR3 is a chain drive for the feed rollers R1, R2. The feed rollers R1, R2 are two 12" wide×6" dia. urethane coated rollers located at top and bottom of the input to the machine. The top roller R1 has a hold-down pressure through a 1½" dia. air cylinder AC3 that is variable thru a pressure regulator. Two additional sets of hold down rollers R3, R4 are smooth steel rollers top and bottom 6" dia.×12" with air cylinder AC4 mounted above the top roller, and bottom roller fixed mounted at the machine bed height.

The actual saw distressing is done by two saw arbors A1, A2 mounted on a beam that is above the feed bed. The saw arbors are variable speed using a variable speed pulley and adjustable motor base. This allows the spacing of the saw marks to be adjusted relative to the desired feed speed to achieve a realistic sawn texture like an old-fashioned circular sawmill would leave. The saw blades are 14" diameter with 20 teeth.

Each saw arbor is mounted on a plate with the drive motor (M1, M2) as a unit. Each plate is mounted on a pivot to allow the saw blade to move up and down as the plank is fed. The arbor plate is pivoted back and forth using a lever (CL1, CL2) that rides on a special cam (C1, C2) using a cam follower and small air cylinder (AC1, AC2) for pressure.

Figure 3:
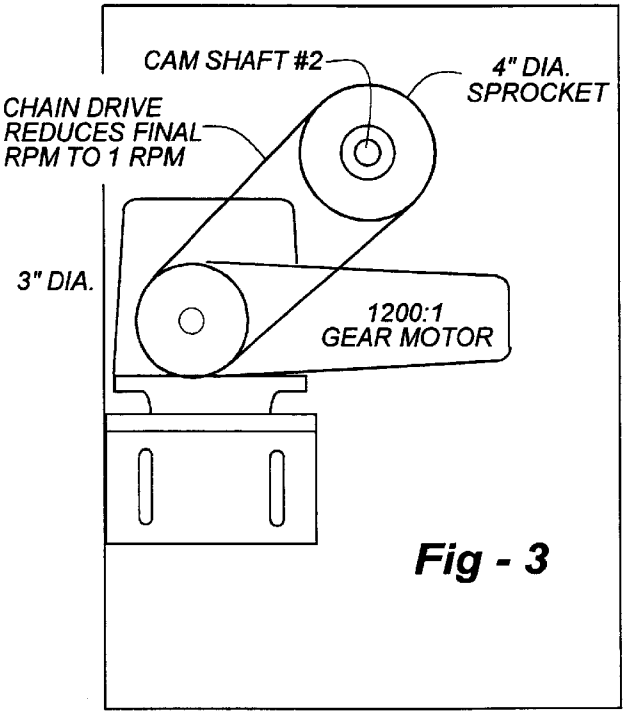
FIG. 3 is an end-view drawing of a cam drive assembly in the random saw distresser.
Figure 2:
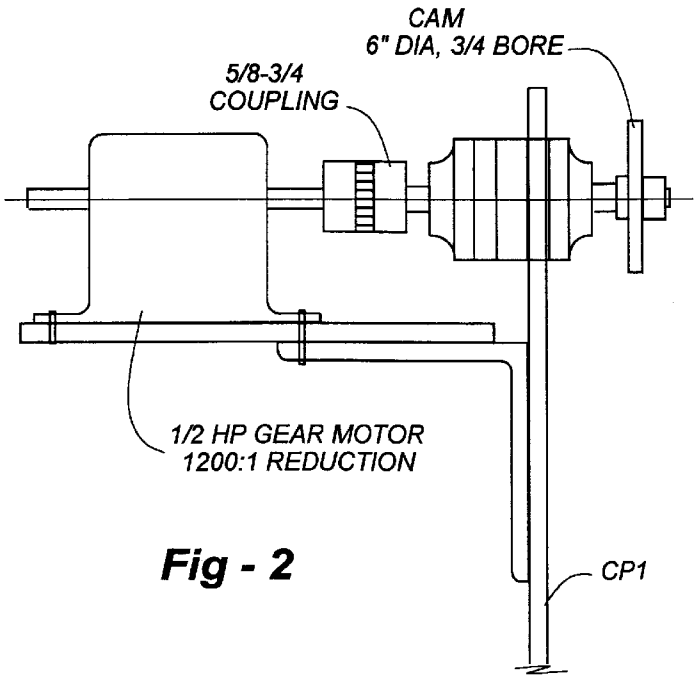
FIG. 2 is a detail drawing which shows a cam drive assembly for the random saw distresser.
Figure 4:
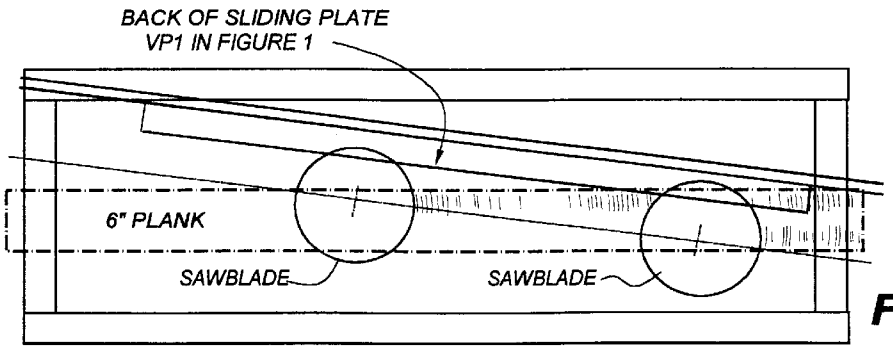
FIG. 4 illustrates how one arbor of the random saw distresser affects one half of a plank, with a different arbor affecting the other half of the plank.

The cam, cam motor, cam lever and corresponding air cylinder is mounted to a plate labeled CP1, CP2. The entire arbor assembly including saw arbor, motor, and cam unit is mounted on a vertical adjustment plate, VP1, VP2, to allow for height adjustment of the saw blade. The beam is adjustable to accommodate different width plank using an adjustment screw at both ends of the beam allowing it to move horizontally to spread the two points of contact on the plank to achieve the optimum saw distressing pattern for a given width. FIG. 2 is a detail drawing which shows a cam drive assembly for the random saw distresser, and FIG. 3 is an end-view drawing of a cam drive assembly according to the invention. As best seen in FIG. 4, arbor A1 would preferably hit one half of the plank, whereas arbor A2 would hit the other half of the plank.

Achieving Randomness with the Saw Distresser

Each arbor cam has its own unique shape and rpm. Cam #1 preferably turns at 1.5 rpm using a 1200:1 gear reducer in a direct-drive arrangement. Cam #2 turns at 1 rpm using a 1200:1 reducer and chain and sprocket to reduce 3:2 giving final reduction of 1800:1. Due to the two different cam speeds and unique cam shapes, there is no repeating saw pattern. As a result, no two planks will have the same saw distressing, i.e. each plank is unique. This is critical to achieving a realistic antique distressed look as described above. Each arbor is adjustable vertically to control the intensity of the saw distressing. In general it is desirable have 20–30 percent of the surface distressed, leaving the remainder untouched. The areas which are distressed vary randomly in intensity, length, width, texture and spacing. Apart from the substantial randomness built into the distressing machine, there are other significant factors relating to the wood itself that further enhance the realistic distressing effect. For one, the wood is random with respect to flatness. This adds an additional random variable to the process that causes each plank to have potentially different looking saw texture. Planks that have high spots are hit much harder, sawing much deeper into the surface causing a much different effect than planks that are flat. This greatly increases the variety of saw textures, and makes a very realistic final product. The planks also have random lengths, which further guarantees that no two planks will come out exactly alike.

Roller Distresser

Figure 6:
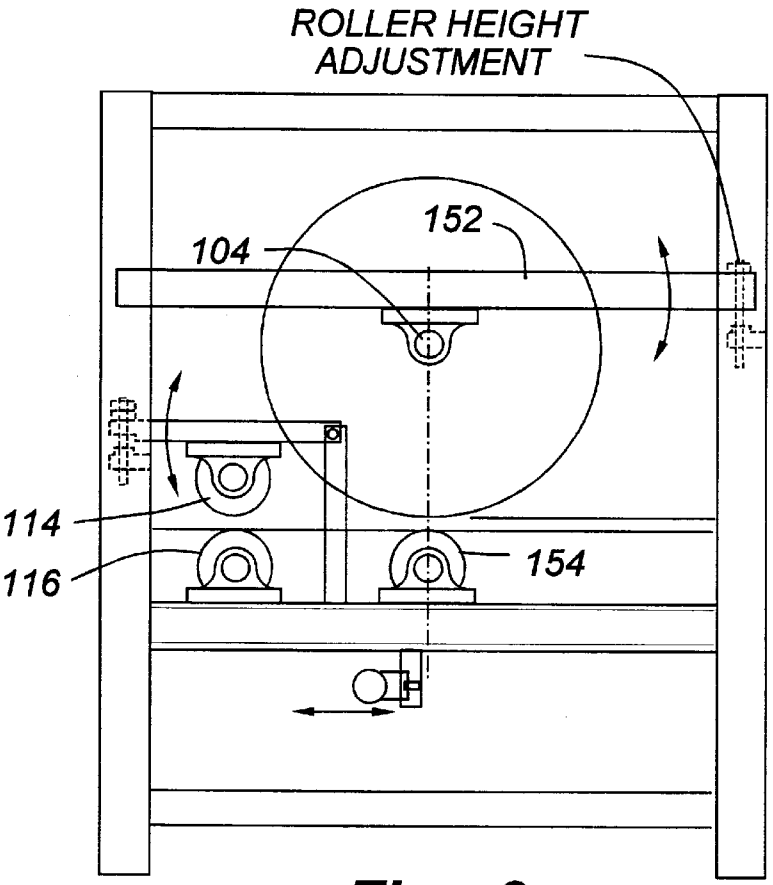
FIG. 6 shows a different view of the roller distresser machine.
Figure 5:
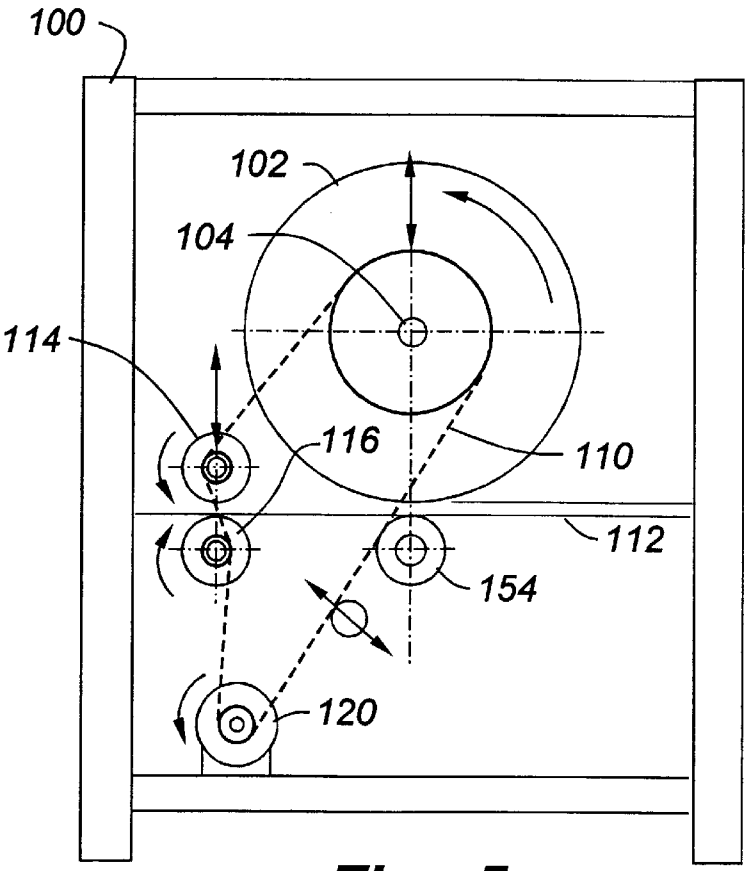
FIG. 5 shows the random-length planks being fed into a roller distresser according to the invention.

The random-length planks are fed into a roller distresser, depicted in FIGS. 5 and 6. The order of the boards is preferably mixed up compared to the order they came out of the saw distresser. This also enhances the randomness because the finished product is not sequential planks in the order they came out of the saw distresser.

The roller distresser machine was custom designed and built to achieve a realistic simulation of indentations found in 100 to 200 year old plank flooring. Broadly, the machine puts random indentations in the surface of plank flooring much like the dents found in old plank flooring from years of boot traffic, high heel dents, stones, etc. The randomness of size, shape, intensity, and concentration is critical to achieving a realistic distressed plank floor.

The frame 100 of the roller distresser uses 4" square tube, approximately 5' wide by 6' long by 7' high. The distressing roller 102 is 30" dia.×36" wide×⅜" thick, mounted on a 3" dia. shaft 104 and is driven by chain 110. The feed bed 112 is 36" wide×6' long of flat plate steel. The feed system uses two urethane rollers 114, 116, 6" dia.×36" long chain driven by the same chain as the distressing roller. The drive system is a ¾ hp 60:1 gear reducer 120 driving the single chain 110 as shown.

As best seen in FIG. 6, the distressing roller shaft 104 is mounted using pillow block bearings 150 on square tube arms 152 such that the arms have a mechanical advantage applying pressure, with weight only, to the distressing roller. Mounted directly below the distressing roller at the feed bed height is an idle roller 154. This is a steel 6" dia.×36" that provides smooth feeding thru the machine.

The impression roller has random welds all over the surface which are done creatively using a standard arc welder and ⅛" welding rod. Random "squiggles" (continuous beads with irregular paths) are applied to the surface of the drum with random length, spacing, and direction. Care is taken so that every squiggle is unique so there can be no repeating pattern. The height of the squiggles must be relatively consistent within a tolerance of about 1/32" +/− so that high spots don't raise the roller and prevent contact across the rest of the width of the drum. The mass of the distressing roller, 3" shaft, and arm assembly (approx. 1000 lbs) applies enough pressure to impart very realistic impressions in the hardest domestic hardwood, northern hickory.

Achieving Randomness in the Roller Distresser

The large surface area of the roller, which is 30" dia.×36" wide, allows for a very large number of unique random impressions. The open feed bed arrangement allows multiple streams to be randomly positioned across the roller, potentially different for every plank. The randomness of the shape of the impressions makes it impossible to see any type of pattern in the finished product. The type of impressions used is not machine-like and are not recognizable forms. Instead the forms are very realistic to what real old plank flooring looks like.

Surface Texturing Machine

The machine used here is a standard production built machine, namely an Italian built STEMAS model LSAC-06, 6 spindle profile sander. This machine is designed for profile sanding on architectural moldings. Because of the very flexible design, this machine was applied to the distressing process "as is," with some special tooling and setup work to accomplish the texturing step.

The machine includes 6 spindles. According to this invention, the first three spindles are used for wire brushing the surface. This tears out the soft grain and produces a raised grain effect. It also removes the chips and smoothes out the rough saw marks put in by the saw distressing operation. The first two spindles are setup with wide wire wheels of coarse texture and run in reverse the normal direction. This does the best job of removing the chips.

The machine includes coarse wire wheels which are used for the most aggressive texturing, raising the grain, yet leaves the surface fairly rough to the touch. The third spindle is setup with a fine wire wheel, which begins to smooth out the roughness of the preceding operations. The forth spindle is setup with a mixed flap wheel containing sandpaper flaps and "Scotchbrite" type abrasive alternating. This sands out and smoothes the top surface of the plank very well, but does not get down in the distressed areas that are below the surface. The last two spindles are setup with "Scotchbrite" type abrasive wheels to do the final smoothing of the textured areas below the top surface. The end result is a surface smooth to the touch, including areas that have been heavily distressed by the saws and wire brushes, even at the bottom of the most aggressive saw marks.

The end product can be finished on a jobsite using conventional manual finishing techniques or it can be prefinished using a state-of-the-art high production UV flat line.

Summary of the Process

The raw material going into the process is preferably long plank flooring after it is completely milled, tongue and grooved, and end matched. The planks are processed in batches of like species and width, e.g. all 6" quarter-sawn white oak would be processed as a batch.

Step 1: "Random Saw Distressing." In this step, planks are run through the saw distressing machine as a single stream, end to end. The machine automatically does the random saw blade distressing as the plank is fed thru the machine. The operator is required only to feed the machine one board at a time (referred to as "single stream").

Step 2: "Roller Distressing". In this step, planks are fed into a large roller machine in multiple streams. Planks are inserted across the machine bed in a random fashion as many as 4 or 5 at a time, which are fed straight thru by the roller machine. The roller makes impressions or dents in the face of the flooring as it passes thru.

Step 3: "Surface Texturing". Planks are run in a single stream thru a 6 spindle profile sander applying texture to the surface with wire wheels, then sanding and smoothing with abrasives wheels. The wire brushes tear our some of the soft grain to give a raised grain effect. The sanding and abrasive wheels following sand and smooth out the roughness to simulate years of wear and smoothing by boot traffic.

At this point the planks are completely milled and distressed. They can be packaged and sold as unfinished distressed plank, ready to install and finish on the jobsite with no further preparation or sanding. This floor can be installed, stained, and finished for a complete antique random plank appearance. Alternatively, the planks can be prefinished with a special process to produce a completely finished ready to install product.

Step 4: "Special Prefinishing Process". This is accomplished using a state-of-the-art UV flat line in a unique 2-pass process, as follows:

a.) Planks are lightly sanded with a wide belt sander first to prepare surface to receive the stain. Care is taken to leave the texturing, yet sand enough to open the surface of the grain so it can absorb the stain down into the wood.

b.) Stain is applied with a sponge roller and heat cured. At this point a black stain is used to darken the edges and highlight the grain pattern in the plank. The stain is heat cured in a drying oven as it passes thru.

c.) The rest of the finishing equipment is turned off at this point. The plank just passes thru the rest of the finish line and is stacked on pallets at the end.

d.) On the second pass thru the same UV flat line the stained plank is re-introduced at the front of the line into the wide belt sander. First the plank is lightly sanded with fine grit paper to sand off the black stain on the top surface, yet leaving the black down in the grain and on the beveled edges which are below the reach of the wide belt.

e.) Next the sanded plank is sealed with a low sheen UV cured urethane sealer.

f.) The sealer is sanded with a special wide belt sander called a "sealer sander" which smoothes out the surface of the urethane coating and prepares it for the finish.

g.) Next, 2 coats of very low sheen urethane finish are applied and UV cured.

h.) The finished product is packaged in boxes at the end of the finishing line in 8' and 10' boxes to accommodate the long plank.

EXAMPLE

Prefinished Distressed Long Plank Flooring

The following example will be used to describe a preferred process whereby raw material is worked according to the invention to produce distressed long plank flooring having the following characteristics:

¾" thick solid hardwood, multiple species (e.g. White Oak, Hickory, Cherry . . . )

Multiple widths: 4", 5", & 6"

Random lengths between 2' and 8'

Tongue & groove and end-matched

Bevel edges and beveled ends, (1/32" bevel)

To produce an antique aged look, the machines described above are applied in the following manner:

1. Randomly applied saw distressing on the top surface simulate flooring that was once installed in a rough sawn form and used in this form for years before being finished. In the 1700s and 1800s when local sawmills produced rough sawn lumber out of local timber, this was used directly as building material including flooring without being surfaced by a planer first. These saw marks would be left randomly in the low spots even after multiple sanding applications have been done over a period of many years.

2. Randomly applied indentations: The process applies dents that are random in size, shape, depth and spacing to have no repeating pattern. These dents are similar to dents found in 100 to 200 year old plank floors.

3. Surface texturing: Surface is textured to simulate 100 years of boot traffic that wears away at the soft grain in the hardwood and polishes the hard grain on top to give a raised grain effect. The surface texturing also smoothes down the rough saw texturing as if the planks were wore down and smoothed out with years of boot traffic.

4. Special Prefinishing Process: Simulates an antique floor that has been distressed over a 100 year period and carefully refinished as part of a building restoration, keeping as much authentic character as possible. In particular, the special prefinishing process produces beveled edges and ends which are much darker than the rest of the plank as an authentic restored plank floor would have. Black stain is "down into the grain" as an aged floor would have from the years of traffic darkening the soft grain while polishing and lightening the top surface hard grain. The top surface hard grain is the color of the wood species and the detail of the grain is clear and defined. There is no muddy or opaque stain that is artificial. This gives the appearance of a very old floor that has been sanded and refinished to show the "real wood" color yet maintaining the old look to the floor. Finally the urethane finish is an ultra low gloss, (matte finish) which further helps convey the aged look.

I claim:

1. A method of distressing a wooden plank so as to give it an antique aged appearance, comprising the steps of:

running the plank through a machine operative to impart a random saw blade distressing on the plank;

providing a roller having raised portions of random size, shape, and concentration;

feeding the plank into a roller operative to produce random dents and impressions into the plank;

feeding the plank into a profile sander having one or more wire wheels operative to apply the surface texture to the plank, then sanding and smoothing the plank with abrasive wheels; and applying a surface finish to the plank.

2. The method of claim 1, wherein the step of running the plank through a machine operative to impart a random saw blade distressing is carried out on a per-plank basis.

3. The method of claim 1, wherein the step of feeding the plank into a roller operative to produce dents and impressions is carried out on multiple planks simultaneously.

4. The method of claim 1, wherein:

the plank has edges and ends; and the step of applying a surface finish to the plank includes beveling the edges and ends of the plank.

5. The method of claim 1, wherein:

the plank has areas of relatively hard grain and areas of relatively soft grain; and the step of applying a surface finish to the plank includes the step of darkening the soft grain.

6. The method of claim 1, wherein:

the plank has areas of hard grain and areas of soft grain; and the step of applying a surface finish to the plank includes lightening the hard grain.

7. The method of claim 1, wherein the machine used to impart a random saw blade distressing on the plank includes a plurality of saw arbors, each driven by its own rotating cam.

8. The method of claim 1, wherein each cam has a different shape.

9. The method of claim 1, wherein each cam rotates at a different speed.

* * * * *